United States Patent [19]

Andrews

[11] Patent Number: 4,605,934

[45] Date of Patent: Aug. 12, 1986

[54] BROAD BAND SPIRAL ANTENNA WITH TAPERED ARM WIDTH MODULATION

[75] Inventor: George S. Andrews, Kent, Wash.

[73] Assignee: The Boeing Company, Seattle, Wash.

[21] Appl. No.: 637,121

[22] Filed: Aug. 2, 1984

[51] Int. Cl.[4] ..... H01Q 1/36

[52] U.S. Cl. ..... 343/895

[58] Field of Search ..... 343/895, 908

[56] References Cited

U.S. PATENT DOCUMENTS

| | | | |
|---|---|---|---|
| 2,958,081 | 10/1960 | Dyson | 343/895 |
| 3,344,425 | 9/1967 | Webb | 343/16 |
| 3,381,297 | 4/1968 | Zisler et al. | 343/113 |
| 3,454,951 | 7/1969 | Patterson et al. | 343/895 |
| 3,465,346 | 9/1969 | Patterson et al. | 343/895 |
| 3,562,756 | 2/1971 | Kuo | 343/895 |
| 3,633,210 | 1/1972 | Westerman | 343/895 |
| 3,681,772 | 8/1972 | Ingerson | 343/895 |
| 3,787,871 | 1/1974 | Reese | 343/895 |
| 3,949,407 | 4/1976 | Jagdmann et al. | 343/895 |
| 3,969,732 | 7/1976 | Holloway | 343/895 |
| 4,087,821 | 5/1978 | Phelan | 343/895 |
| 4,243,993 | 1/1981 | Lamberty et al. | 343/895 |

FOREIGN PATENT DOCUMENTS

| | | | |
|---|---|---|---|
| 2707819 | 1/1977 | Fed. Rep. of Germany | 343/895 |

*Primary Examiner*—Eli Lieberman

*Attorney, Agent, or Firm*—Christensen, O'Connor, Johnson & Kindness

[57] ABSTRACT

Disclosed is a multiarm spiral antenna for wideband transmission and reception of both right-hand and left-hand circularly polarized electromagnetic energy. Each antenna arm includes a series of cells wherein the impedance of the antenna arm monotonically decreases over a first portion of the cell length and monotonically increases over a second portion of the cell length to thereby provide the signal reflection necessary for mode conversion (operation in both polarization senses) without introducing abrupt impedance transitions. Various cell geometry that can be employed is described.

17 Claims, 22 Drawing Figures

BROAD BAND SPIRAL ANTENNA WITH TAPERED ARM WIDTH MODULATION

BACKGROUND OF THE INVENTION

This invention relates to center fed multiarm spiral antennas that are configured for transmission and reception of either left- or right-hand circularly polarized electromagnetic energy.

As is known in the art, a center fed, multiarm spiral antenna having N-arms exhibits N−1 independent operating modes wherein the individual operating modes are determined by the phase difference between the currents induced in the antenna arms. In particular, a first operational mode (commonly referred to as the sum or Σ mode and identified herein as the M=1 mode) is attained when the phase difference between the excitation currents in adjacent antenna arms is $2\pi/N$ radians. This mode of operation produces a circularly polarized, symmetrical, single lobed radiation pattern that exhibits maximum field strength along the antenna boresight axis. Higher order modes (i.e., M=2, 3 . . . , [N−1]), often called difference (or Δ) modes, are attained when the phase difference between the current in adjacent antenna arms is $2\pi M/N$ radians. Each of these higher order modes is characterized by a radiation pattern that exhibits a null along the antenna boresight axis and maximum field strength along a cone of revolution about the boresight axis, with the cone angle increasing and the relative peak field strength decreasing as the mode number increases.

As is also known in the art, each operating mode, M, of a center fed multiarm spiral antenna exhibits a circular radiation zone that is $m\lambda/\pi$ in diameter, where λ is the freespace wavelength of the antenna operating frequency. These modes exhibit right-hand circular polarization when the antenna is wound in the counterclockwise direction and exhibit left-hand circular polarization when the antenna is wound in the clockwise direction.

To obtain simultaneous right-hand and left-hand circular polarization with a center fed multiarm spiral antenna, a technique known as "mode conversion" is utilized wherein the antenna is configured such that the electrical length of the antenna arms and hence the effective antenna radius is less than that required to emit radiation at one or more of the higher operating modes. In such an arrangement, excitation currents that would normally result in an operating mode that is higher than the modes that can be supported by the electrical radius of the antenna are reflected and flow inwardly toward the center of the antenna. When the reflected, inwardly flowing currents of the adjacent antenna arms reach an in-phase condition, the antenna radiates circularly polarized electromagnetic energy that exhibits an equivalent (or converted) mode order of N−M, where M is the original or normal mode number. As previously stated, the polarization sense of each converted mode is opposite to the polarization sense that would normally be induced in the antenna: Thus, both right- and left-hand circular polarization are simultaneously exhibited by a single spiral antenna. For example, a six-element logarithmic (equal angle) spiral antenna that is wound in the counterclockwise direction and configured to exhibit an equivalent electrical circumference of 3 λ will exhibit right-hand circular polarization for mode numbers 1 and 2 (phase difference of $\pi/3$ radians and $2\pi/3$ radians respectively, at the antenna feed points). However, when excitation currents that would normally result in operating modes 4 and 5 are induced (phase difference of $4\pi/3$ radians and $5\pi/3$ radians, respectively, at the antenna feedpoints), the antenna will exhibit left-hand circular polarization at mode numbers 2 and 1 by virtue of the mode conversion process.

As is known in the art, and as is demonstrated by Kuo et al., U.S. Pat. No. 3,562,756, converted mode spiral antennas that operate over a relatively narrow frequency range can be realized by suitably establishing the physical length of the antenna arms so that reflection occurs at the physical termination of each antenna arm. As is disclosed, for example, in Ingerson, U.S. Pat. No. 3,681,772 and Lamberty et al., U.S. Pat. No. 4,243,993, converted mode operation can be attained over a relatively wide frequency range by controlling the effective electrical length of each antenna arm rather than by physically terminating the antenna arms. In effect, such antennas are configured so that the electrical length of each antenna arm is inversely proportional to the frequency of the excitation signal. In the ideal case, such a configuration thus provides an antenna having a constant electrical radius relative to the wavelength of signals within the antenna bandwidth.

In the arrangement disclosed in the above-referenced patent to Ingerson, which is identified as a modulated arm width (MAW) spiral antenna, each antenna arm is formed by a series of "cells" with each cell being a section of antenna arm that includes a first, relatively narrow width dimension followed by a second section of antenna arm of substantially greater width dimension. These cells or "modulations" are positioned along the antenna arms to establish impedance discontinuities or reflection regions (denoted as "stop bands" in the Ingerson patent) which are intended to selectively reflect the outwardly flowing currents. In the arrangement disclosed by Ingerson, outwardly flowing currents are reflected when the length of a cell corresponds to λ/2. Thus, in concept, a relatively constant electrical radius can be obtained by utilizing a plurality of modulations in each antenna arm with cell length increasing as a function of the distance between the center of the antenna and the location of a particular cell. By also establishing the position of the arm width modulations (cells) so that currents produced by higher modes of excitation are reflected, whereas the lower modes produce radiation in the conventional manner, operation is achieved with both left-hand and right-hand circular polarization.

In the spiral antenna disclosed in the previously referenced patent to Lamberty et al., the cells are configured to form choke (reactive) elements which cause each cell to resonate at predetermined frequencies. In effect, each antenna arm of the apparatus disclosed by Lamberty et al. can be considered to be a series of cascaded, parallel resonant circuits that are interconnected with transmission lines wherein each successive resonant circuit exhibits a somewhat lower resonant frequency and the length of the interconnecting transmission lines increase with respect to each successive pair of resonant circuits. In the spiral antenna configuration disclosed in the patent to Lamberty et al., appropriately positioning the choke elements and suitably establishing the distance therebetween results in converted mode operation with the antenna exhibiting a relatively constant electrical radius.

Although spiral antennas of the type disclosed by Ingerson and Lamberty et al. are satisfactory in some situations, both of these arrangements exhibit some disadvantages and drawbacks. In particular, neither the abrupt impedance transitions of antennas configured in accordance with the teaching of Ingerson nor the resonant cell structure of spiral antennas constructed in accordance with the teaching of Lamberty et al., totally reflect outwardly flowing antenna excitation currents. The residual excitation current that is not reflected and continues to flow outwardly along the spiral antenna arms not only reduces the relative field strength of the converted mode radiation that is induced by the reflected energy, but also results in other undesired effects. In this regard, the cells of an antenna configured in accordance with the teaching of the Ingerson and Lamberty et al. patents contain abrupt arm width transitions and thus nearly frequency independent impedance discontinuities. These discontinuities reflect signals at the cell design frequency and at integer multiples thereof. Thus, excitation current that passes beyond the desired electrical radius of the antenna (i.e., current that is not reflected from the cell of length $\lambda/2$ in the arrangement disclosed by Ingerson and the cell that exhibits fundamental resonance at the excitation frequency in the apparatus disclosed by Lamberty et al.), can be reflected both by the physical terminus of the antenna arm and by the impedance discontinuities of the outwardly located cells that are designed to reflect energy at a different (lower) frequency. Any such additional reflection causes additional undesired radiation.

Futher, some difficulty can be encountered in fabricating a spiral antenna of the type disclosed in the Lamberty et al. patent for use at higher microwave frequencies. In this regard, realization of a high Q (quality factor) for the high frequency reactive cells requires that the width of conductors with the cell (and the spacing therebetween) be closely controlled. When the required dimensional constraints are not fully met, cell signal reflection decreases below the design value and an undesired amount of the excitation current passes outwardly beyond the desired reflection point.

The failure of the prior art antennas to act as ideal constant electrical radius antennas and the attendant undesired radiation can cause asymmetry of the radiation patterns relative the antenna boresight axis. Moreover, because of the undesired radiation, the characteristics of a prior art spiral antenna are to some degree both frequency and polarization dependent. Although this nonideal performance may not substantially affect performance of some systems that use a spiral antenna, substantial compromises in system performance and/or system complexity can result in certain systems that require highly symmetrical radiation patterns and uniform frequency characteristics. For example, amplitude monopulse tracking systems or angle-of-arrival systems that ideally are independent of received signal polarization and continuously operable over a multi-octave frequency band require an antenna having radiation patterns that are highly symmetric about the antenna axis and are substantially independent of both frequency and polarization sense.

SUMMARY OF THE INVENTION

The invention provides a wide band multiarm spiral antenna that is configured for converted mode operation (operation with both right-hand and left-hand circularly polarized electromagnetic waves) wherein the antenna is structured to provide improved radiation pattern symmetry and improved uniformity of frequency response. In accordance with the invention, each antenna arm consists of a series of cells that are configured to reflect current flowing outwardly through the antenna arm with each cell being configured to exhibit an electrical impedance that monotonically decreases (as the distance from the cell to the center of the antenna increases) over a first portion of the cell length and an electrical impedance that monotonically increases over a second portion of the cell length. Structuring the antenna in this manner eliminates the abrupt impedance transitions present in prior art wide band multiarm spiral antennas but does not result in a significant reduction in the reflection coefficient exhibited by each antenna cell at the design frequency for that particular cell. However, in contrast with the prior art, the reflection coefficient of cells configured in accordance with the invention rapidly decreases with frequency. This means that less reflection occurs with respect to antenna current that passes beyond cells that are designed to provide reflection at the antenna current frequency. In addition, since the cells utilized in the present invention do not include abrupt impedance transitions, the reflections that do occur because of antenna current that passes beyond the cells that are designed to reflect that antenna current are distributed over the ideally nonradiating outer portion of the antenna arm to thereby substantially reduce the magnitude of standing waves and distortion of the antenna radiation pattern.

In the disclosed embodiments of the invention, the antenna is a substantially planar spiral antenna with each antenna arm being a strip of conductive material that defines a series of reflective cells. To achieve the desired monotonic decrease and increase in electrical impedance within each cell, the width of the conductive strip uniformly increases as a function of length throughout a first portion of each cell and uniformly decreases throughout a second portion of each cell. In this regard, the geometry of each cell can be established so that the variation in electrical impedance within each cell is a linear function of distance along the cell, an exponential function of distance along the cell, a hyperbolic function of distance, a gaussian function, or a sinusoidal function. Further, the cells of the invention can be structured so that, within each of the two abovementioned portions, the ratio obtained by dividing the distance from the edge of the cell to a radially adjacent cell by the width of the cell is a linear function of distance along the cell, an exponential function of distance, a hyperbolic function, a gaussian function, or a sinusoidal function. In addition, satisfactory results can be achieved wherein the geometric curve defined by each of the two oppositely disposed edges of each cell in a linear function of distance, an exponential function of distance, a hyperbolic function, a gaussian function or a sinusoidal function.

BRIEF DESCRIPTION OF THE DRAWING

The various aspects and advantages of the present invention will become apparent to one skilled in the art after reading the following description taken together with the accompanying drawing, in which.

DETAILED DESCRIPTION

Figure 1:
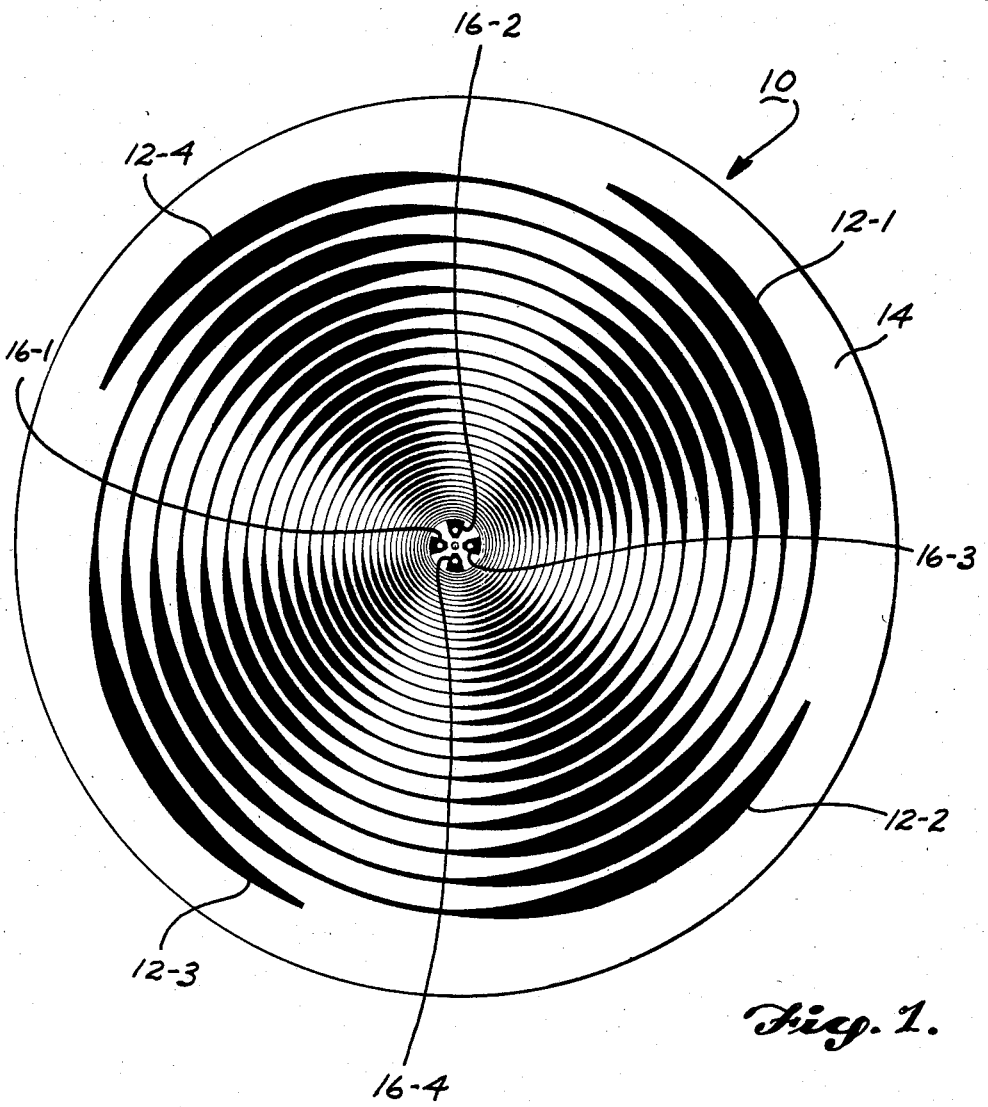
FIG. 1 depicts a multiarm spiral antenna configured in accordance with this invention.

The embodiment of the invention which is depicted in FIG. 1 and generally denoted by the numeral 10, includes four conductive antenna elements or arms 12-1 through 12-4, that are supported on a dielectric substrate 14 and spiral outwardly in the counterclockwise direction from associated terminal regions 16-1 through 16-4. The terminals 16-1 through 16-4 are equally spaced apart from one another to form a circular pattern having a center that coincides with the center of the antenna 10 and provide for electrical interconnection of antenna 10 with circuitry of various RF transmitting and/or receiving systems (not shown in FIG. 1). In accordance with the known practices for constructing conventional multiarm spiral antennas, the antenna 10 can be formed from a metal-clad dielectric substrate in the same manner as conventional printed circuit boards. Although other conventional fabrication techniques can be employed, photographic reproduction and etching processes the same as, or similar to, those used in manufacturing printed circuit boards provide a convenient method of achieving the desired dimensional tolerances and, by selecting either a rigid or flexible substrate material, various antenna configurations can be obtained (e.g., planar or conical).

In the embodiment of FIG. 1, antenna arms 12-1 through 12-4 are of identical length and include an innermost region in which each antenna arm is a continuous ribbon-like conductor so that the center region of antenna 10 in effect forms a small conventional spiral antenna. Outside this central continuous conductor region, each antenna arm 12 consists of a series of cells wherein the antenna arm width dimension initially increases from a minimum width to a maximum width and then decreases again to a minimum width. As shall be described relative to FIG. 2, various cell geometry can be employed in the practice of this invention.

Regardless of the cell geometry employed, each cell exhibits maximum signal reflection when the wavelength of the excitation current that flows in the antenna arm containing the cell is equal to two times the length of the cell. Thus, to attain a relatively constant electrical radius over a frequency range that extends from a lowermost frequency $f_a$ to an uppermost frequency $f_b$, the length of the innermost cell of each antenna arm 12-1 through 12-4 is $\lambda_b/2$ (where $\lambda_b$ is the wavelength of a signal at frequency $f_b$) with the innermost cells being positioned to provide the desired electrical radius (i.e., to reflect high mode orders of the excitation current) when the excitation current is at frequency $f_b$. For example, in configuring the four element antenna of FIG. 1 for reflecting currents associated with mode order 3, the innermost cells of antenna arms 12-1 through 12-4 are positioned within an annular region of the antenna 10 that is approximately bounded by concentric circles of circumference $2\lambda_b$ and $4\lambda_b$. Likewise, each outermost cell of antenna arms 12-1 through 12-4 is approximately $\lambda_a/2$ in length and is located within an annular region that is approximately bounded by concentric circles of $2\lambda_a$ and $4\lambda_a$. As shown in FIG. 1, the remaining or intermediate cells of each antenna arm 12-1 through 12-4 are positioned between the innermost and outermost antenna cells and exhibit physical lengths that correspond to one-half the wavelength of predetermined signal frequencies that lie between $f_a$ and $f_b$. For example, in the case of a logarithmic or equal angle spiral antenna, the length dimension of the cells within each antenna arm 12-1 through 12-4 increases logarithmically as a function of distance from the center of the antenna so that antenna 10 forms a geometric pattern wherein the cells lie within quadrants of a circle. In this regard, in the embodiment of the invention depicted in FIG. 1, 24 cells lie within each quadrant of the circular pattern formed by the antenna, with 6 of the cells in each quadrant defining a portion of each antenna arm 12-1 through 12-4. In this arrangement, the width dimension of each cell also increases logarithmically as a function of the distance between the cell and the center of the antenna 10, although the ratio between the maximum width and minimum width remains constant.

Figures 2A, 2B, 2C, 2D, 2E, 2F:
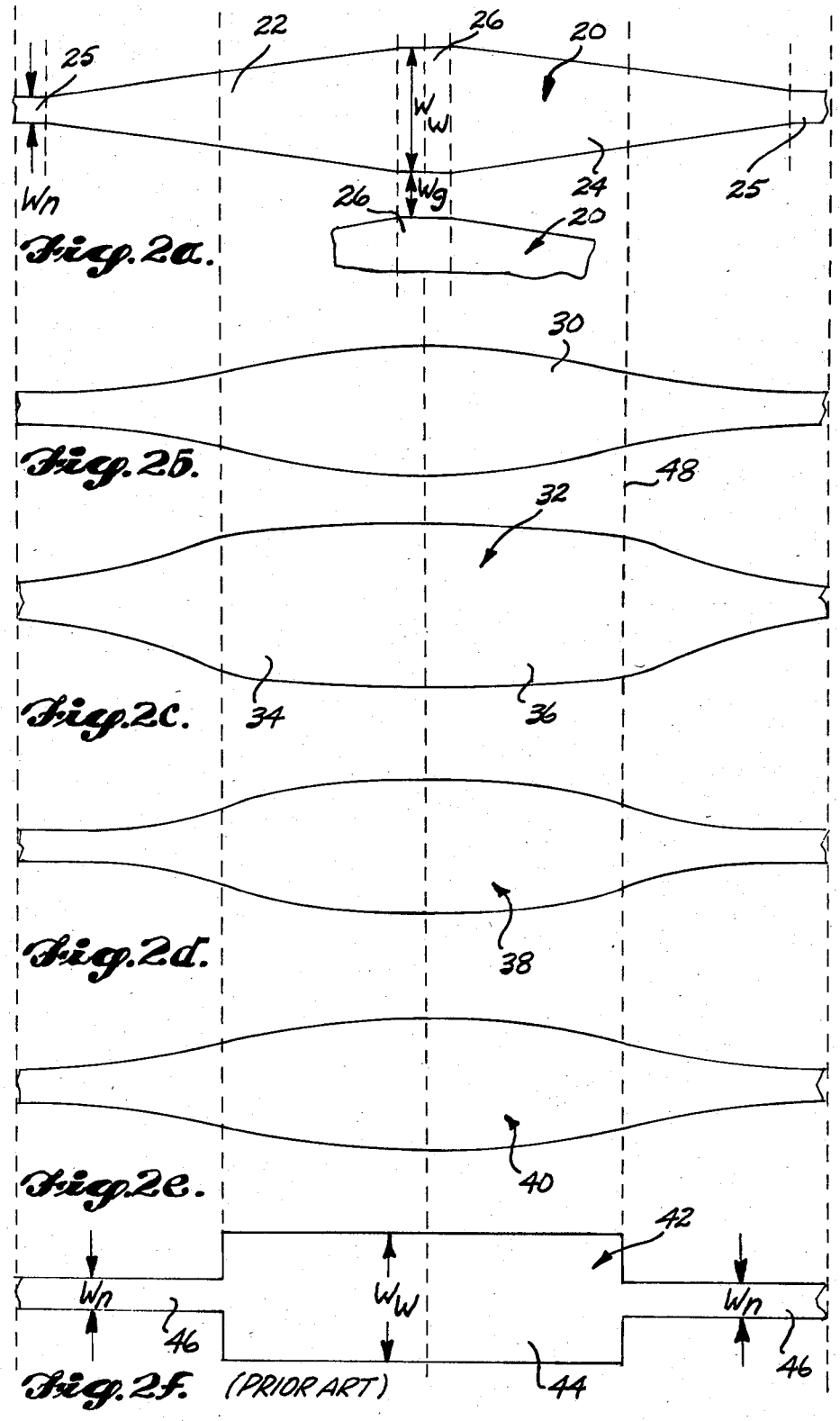
Fig. 2f. (PRIOR ART)
FIGS. 2*a*–2*e* illustrate various antenna arm cell geometry that can be utilized in the practice of the invention and FIG. 2*f* illustrates typical prior art antenna cell geometry.

The structure of the cells utilized in the antenna of FIG. 1 and alternative cell structure that can be employed in the practice of the invention can be understood with reference to FIGS. 2*a*–2*e*. In this regard, the cells utilized in antenna arms 12-1 through 12-4 of FIG. 1 are one realization of the linearly tapered cells depicted in FIG. 2*a*. For convenience, and for ease of analysis relative to the performance characteristics discussed relative to FIGS. 3–5, the linearly tapered cells of FIG. 2*a* (and the cells of FIGS. 2*b*–2*e*) are shown without curvature. As is shown in FIG. 2*a*, each linearly tapered cell (generally denoted by the numeral 20 in FIG. 2*a*) includes: a first region 22 wherein the width of the cell 20 uniformly increases from a minimum width dimension, $w_n$, to a maximum width dimension, $w_w$; and a second region 24 wherein the width dimension uniformly decreases from the maximum width dimension, $w_w$, to the minimum width dimension of $w_n$. One satisfactory way of uniformly varying the width of first and second regions 22 and 24 is to control the antenna arm width so that the "modulation ratio" (i.e., the ratio between: (a) the distance from any point on the edge of the cell to on the edge of the radially adjacent cell; and (b) the width of the antenna arm at that same point), varies linearly throughout each region 22 and 24. For example, with reference to FIG. 2*a*, the modulation ratio, which is $W_g/W_m$ at the boundary between regions 26 and 24 increases linearly throughout regions 22 and 24. The linearly tapered cell 20 of FIG. 2*a* also includes a region 25 of constant width $w_n$ that extends from the terminus of a region 24 of one antenna cell 20 to the beginning of the region 22 of the next antenna arm cell and further includes a region 26 of constant width $w_w$ that extends between regions 22 and 24 of each particular cell. In the practice of the invention, regions 24 and 22 need not be of identical length and the length of the constant width portions (25 and 26) can be varied over a wide range. The important thing is that each cell include a first region wherein the electrical impedance of the cell smoothly transits from a maximum value to a minimum value (i.e., region 22 in FIG. 2*a*) and further includes a region wherein the electrical impedance smoothly transits from the minimum value to the maximum value (i.e., region 24 in FIG. 2*a*).

FIGS. 2*b* through 2*e* each illustrate alternative types of cell configuration with each of the depicted types providing the required region of uniformly or monotonically decreasing electrical impedance and region of monotonically increasing electrical impedance. In this regard, FIG. 2*b* illustrates an antenna cell 30 wherein the cell modulation ratio varies sinusoidally relative to position along the cell length. FIG. 2*c* illustrates a cell 32 having a region 34 wherein the modulation ratio increases exponentially and a region 36 wherein the cell modulation ratio decreases exponentially. FIG. 2*d* illustrates a cell 38 wherein the modulation ratio increases and decreases as a hyperbolic function of the distance along the cell, and FIG. 2*e* illustrates a fifth alternative arrangement wherein the cell modulation ratio is a gaussian function of distance along the cell.

For the purpose of comparison, FIG. 2*f* illustrates an antenna arm cell 42 of the type disclosed in the previously referenced patent to Ingerson. In FIG. 2*f*, the cell 42 comprises a first conductive region 44 having a length that corresponds to one-fourth the free space wavelength of the antenna arm current that is to be reflected by cell 42. Section 44 of cell 42 is of constant width, $w_w$, and is followed by a relatively narrow section 46, of constant width $w_n$. The length of section 46 also is equal to one-fourth the wavelength of the antenna current to be reflected so that cell 42 exhibits an overall length dimension of one-half wavelength.

Those skilled in the art will recognize that controlling cell width as a linear, exponential, hyperbolic, sinusoidal or gaussian function of distance along the cell in the manner generally depicted in FIGS. 2*a*–2*e* can result in a wide range of cell configurations and, hence, a great deal of flexibility in both the physical topology and electrical characteristics of an antenna configured in accordance with this invention. Further, in accordance with the invention, the cells can be configured so that each cell includes first and second regions wherein the impedance of the cell (rather than cell width) increases and decreases as a linear function of distance along the cell, a sinusoidal function of distance, an exponential function, a hyperbolic function and a gaussian function. In addition, in some arrangements it may be advantageous to configure the cells so that the two oppositely disposed edges of each antenna cell define increasing and decreasing linear functions of distance, sinusoidal functions, exponential functions, hyperbolic functions or gaussian functions.

The advantages of the present invention can be understood with reference to FIGS. 3 through 5, which provide a comparison between various characteristics of antenna arm cells constructed in accordance with the teachings of the previously referenced patent to Ingerson, (i.e., the antenna cell of FIG. 2*f*) and cells constructed in accordance with the present invention, (i.e., the antenna cells described relative to FIGS. 2*a*–2*e*). For ease of analysis and understanding, this comparison is made relative to parallel transmission lines ("strip lines") configured in accordance with the invention and configured in accordance with the teachings of Ingerson.

FIGS. 3*a*–3*e* provide a general comparison of the manner in which the impedance varies along antenna cells constructed in accordance with the invention and contrast that impedance variation with the abrupt impedance transition that is effected by antenna cells constructed in accordance with the teachings of the Ingerson patent. In this regard, FIGS. 3*a*–3*e* respectively depict the impedance variation along the decreasing width region of each type of antenna cell that is illustrated in FIGS. 2*a*–2*e*, with FIG. 3*a* also depicting the abrupt impedance transition exhibited by the juncture of the wide and narrow portions (44 and 46) of prior art antenna cell 42 (FIG. 2*f*).

Figure 3A:
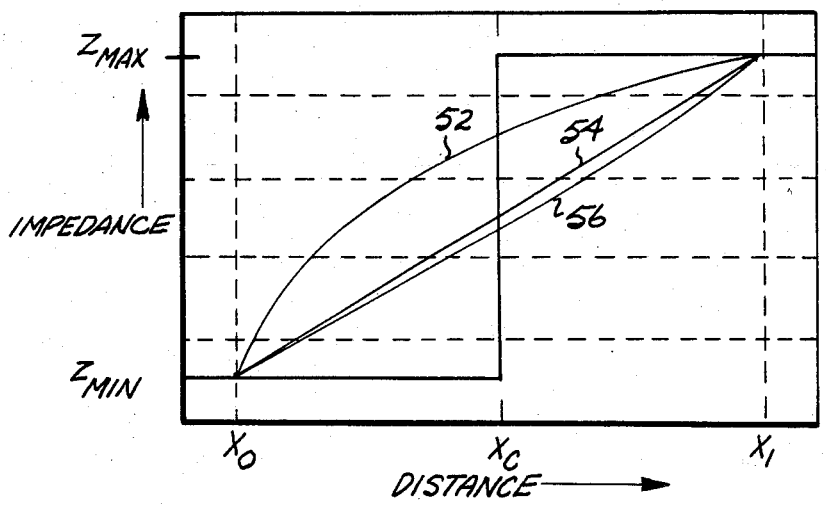
FIGS. 3*a*–3*e* depict the impedance characteristics of the antenna arm cell geometry illustrated in FIGS. 2*a*–2*e*.

More specifically, and with reference to FIG. 3*a*, prior art antenna cell 42 (FIG. 2*f*) exhibits a constant impedance ($Z_{min}$, in FIG. 3*a*) at all points along relatively wide region 44, (distance $x_0$ to $x_c$ in FIG. 3*a*) with the width, $w_w$, determining the value of $Z_{min}$ in a manner that is known in the art. At the juncture between the relatively wide region 44 and the relatively narrow region 46 (the position denoted by the line identified by the 48 in FIG. 2 and the position identified by distance $x_c$ in FIG. 3*a*), the impedance of prior art cell 42 exhibits an abrupt transition to a higher value (denoted as $Z_{max}$ in FIG. 3*a*).

In contrast, the impedance exhibited by the linearly tapered cells described relative to FIG. 2*a* monotonically increases throughout the region over which the width dimension of the cell decreases (e.g., cell region 24 in FIG. 2*a*). In this regard, the impedance curves identified by the 52, 54 and 56 in FIG. 3*a* respectively typify linearly tapered antenna cells of this invention wherein: the modulation ratio of the antenna cell is a linear function of distance throughout regions 20 and 22; the impedance of the antenna cell is a linear function of distance in regions 20 and 22; and the oppositely disposed edges of regions 20 and 22 are defined by linear increasing and decreasing functions of distance. As can be seen in FIG. 3*a*, the impedance of each of the depicted linearly tapered cells is constant (value $Z_{min}$), throughout region 26 of each cell 20 (i.e., for all distances less than $x_0$ in FIG. 3*a*). Within the region of decreasing conductor width (region 24, in FIG. 2*a*; $x_0$ to $x_1$, in FIG. 3*a*), the impedance of each of the linearly tapered cells increases monotonically from $Z_{min}$ to $Z_{max}$. In this regard, as is shown by FIG. 3*a*, the impedance of linearly tapered cells wherein the modulation ratio of the cell varies linearly as a function of distance (curve 52 in FIG. 3*a*) initially increases more rapidly than a linearly tapered cell wherein the impedance is a linear function of distance (curve 54). Thus, at points between $x_0$ and $x_1$, a greater impedance is exhibited by a linearly tapered cell wherein the modulation ratio is a linear function of distance than is exhibited by a cell wherein the impedance is a linear function of distance. On the other hand, the impedance of the cell of FIG. 3*a* in which the oppositely disposed edges of the cell are defined by linear functions of distance (curve 56), initially increases with distance in approximately the same manner as the cell wherein the impedance varies linearly (curve 54), and is slightly less than the linearly varying impedance cell at the midpoint ($x_c$) of the tapered region (20 in FIG. 2*a*).

Figure 3B:
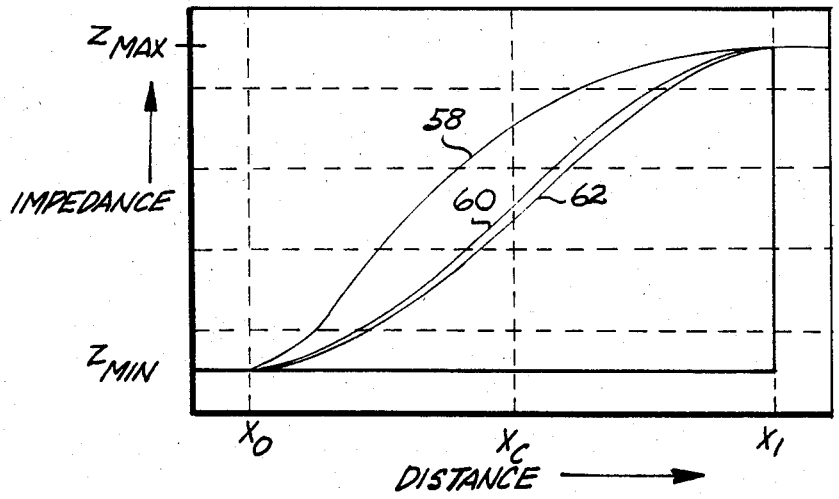

FIG. 3*b* illustrates the impedance versus distance characteristics of the decreasing width portion (i.e., the region between the maximum and minimum widths) of one realization of the type of cell depicted in FIG. 2*b*. In FIG. 3*b*, curve 58 illustrates the impedance of an antenna cell wherein the cell modulation ratio varies sinusoidally as a function of distance; curve 60 illustrates the impedance wherein the cell of FIG. 2*b* is configured so that the impedance is a sinusoidal function of distance; and curve 62 illustrates the impedance of a realization wherein the oppositely disposed edges of the antenna cell are defined by a sinusoidal function of distance. As can be seen in FIG. 3*b*, the impedance characteristics of the sinusoidally varying antenna cells is similar to the impedance functions of the linearly varying impedance cells (FIG. 3*a*) in that, at all points between $x_0$ and $x_1$, the impedance of the realization in which the antenna cell modulation ratio is a sinusoidal function of distance (curve 58) is greater than the sinusoidally varying impedance (curve 60), and the impedance of the realization wherein the oppositely disposed edges define a sinusoidal function of distance (curve 62) is slightly less than the sinusoidally varying impedance (curve 60).

Figure 3C:
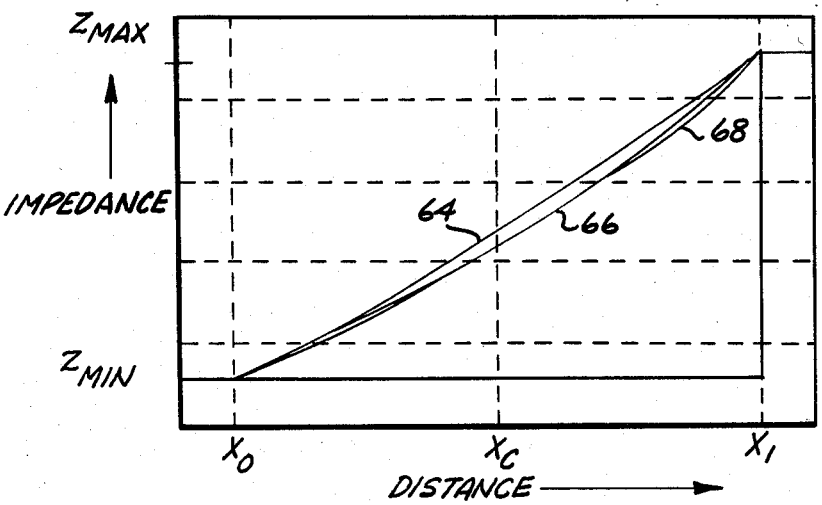

As is illustrated in FIG. 3*c*, the impedance of a realization of the exponentially varying antenna cell (FIG. 2*c*) wherein the antenna cell modulation ratio varies exponentially (curve 64) is slightly greater than the impedance of a realization wherein the impedance is an exponential function of distance (curve 66). As can further be seen in FIG. 3*c*, the impedance characteristic of a realization wherein the oppositely disposed edges of the cell define an exponential function of distance (curve 68) is somewhat less than the exponentially varying impedance (curve 66), throughout a portion of the antenna cell and, is substantially equal to that impedance at points near the center ($x_c$) of the varying width region.

Figure 3D:
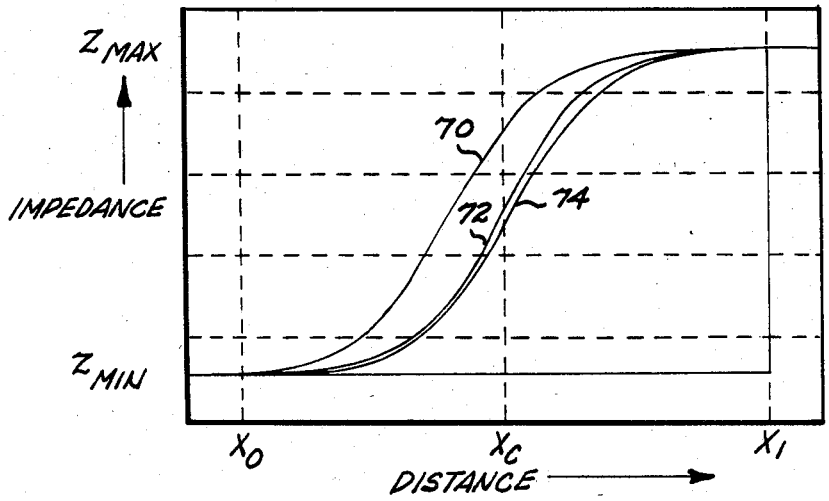

With reference to FIG. 3*d*, it can be noted that the impedance versus distance characteristics of realizations of the type of antenna cell depicted in FIG. 2*d* (hyperbolic variation in cell characteristics) are similar to the impedance characteristics for the antenna cells depicted in FIGS. 2*a* through 2*c*, in that a realization of an antenna cell wherein the antenna cell modulation ratio varies as a hyperbolic function of distance (curve 70 in FIG. 3*d*), exhibits an impedance that is greater than the impedance of a realization in which the impedance is a hyperbolic function of distance. Further, a realization in which the oppositely disposed edges of the antenna cell are defined by a hyperbolic function of distance exhibits an impedance characteristic (curve 74 in FIG. 3*d*) that is less than the impedance of the realization that is configured so that the impedance varies as a hyperbolic function of distance (curve 72).

Figure 3E:
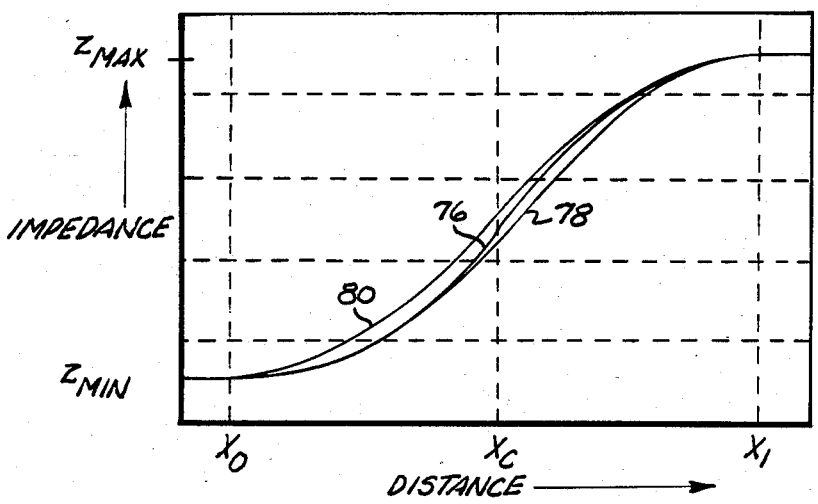

As is shown in FIG. 3*e*, the impedance versus distance characteristics of antenna cells of the type illustrated in FIG. 2*e* (gaussian variation) monotonically increase throughout the region in which the width of the cell decreases. In this regard, as is shown in FIG. 3*e*, the impedance of an antenna cell wherein the cell modulation ratio is a gaussian function of distance (impedance curve 76) is initially substantially the same as an antenna cell having a gaussian impedance variation (impedance curve 78) and, in somewhat greater than the impedance of such a cell for a region extending from slightly less than $x_c$ (the center of the varying width portion of the antenna cell 40) to a point slightly less than the maximum impedance point ($x_1$). The impedance of the antenna cell wherein the two oppositely disposed edges are defined by a gaussian function of distance (impedance curve 80) exceeds the gaussian impedance curve 78 throughout the major portion of the varying width region (i.e., the region between $x_0$ and $x_1$, in FIG. 3*e*.

As will be recognized by those skilled in the art, the reflection that is attained within spiral antennas that includes abrupt impedance cells such as those disclosed in the previously referenced patent to Ingerson and depicted in FIG. 2*f*, does not result from a single cell, but results from the collective effect of a number of the spaced apart antenna arm cells. This is also true of the present invention.

Figure 4A:
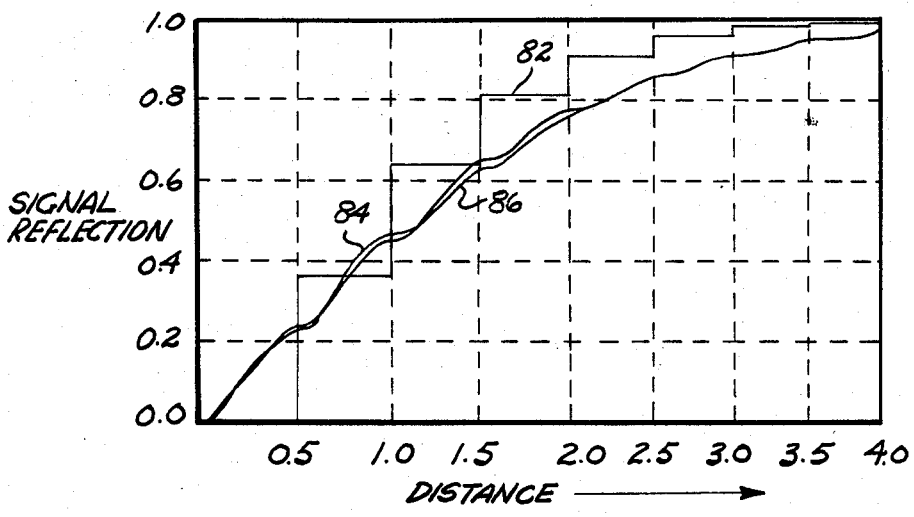
FIGS. 4*a*–4*e* depict the reflection characteristics of a sequence or series of four antenna cells of the type illustrated in FIGS. 2*a*–2*e*.
Figure 4B:
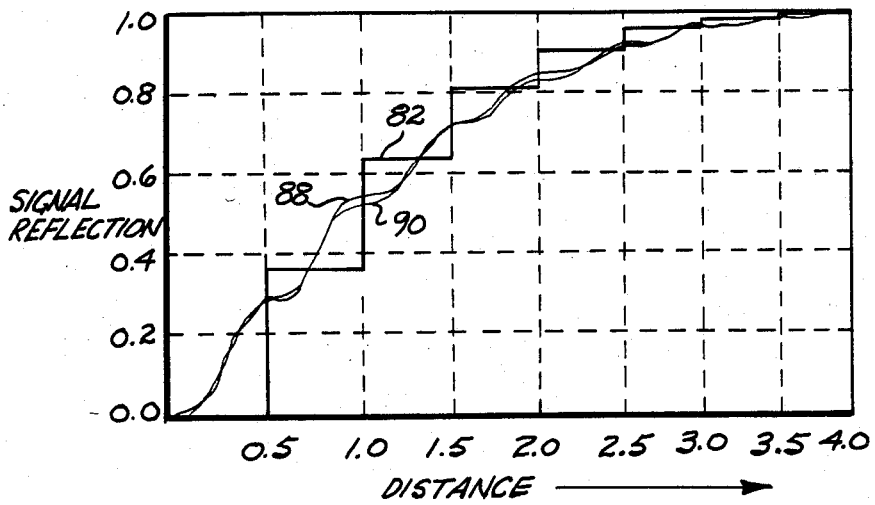
Figure 4C:
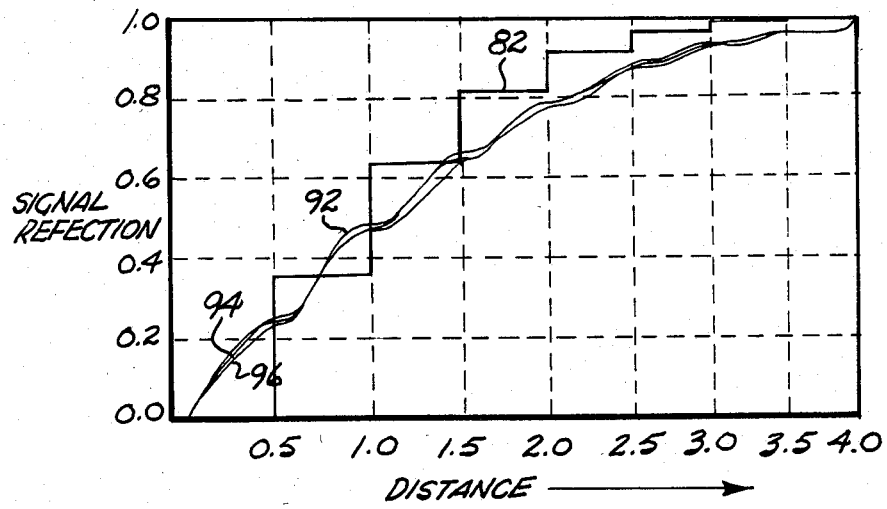
Figure 4D:
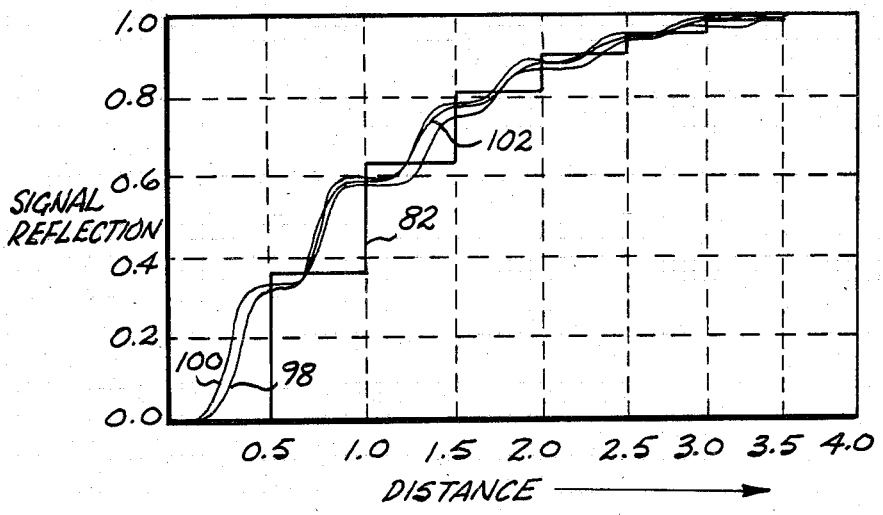

FIGS. 4*a* through 4*e* depict the typical signal reflection characteristics of the antenna cells illustrated in FIGS. 2*a* through 2*e* and provide a comparison with the reflection characteristics of prior art antenna cells of the type depicted in FIG. 2*f*. More specifically, FIGS. 4*a* through 4*e* each illustrate the signal reflection characteristics of a series of four prior art antenna cells of the type illustrated in FIG. 2*f*, (denoted by the 82 in FIGS. 4*a*–4*e*) with: FIG. 4*a* also illustrating the signal reflection characteristics of a series of four antenna cells of the type depicted in FIG. 2*a*, (linearly varying antenna cell characteristics); FIG. 4*b* also illustrating the signal reflection characteristics of a series of four antenna cells of the type depicted in FIG. 2*b*, (sinusoidally varying cell characteristics); FIG. 4*c* also illustrating the signal reflection characteristics of a series of four antenna cells of the type depicted in FIG. 2*c*, (exponentially varying cell characteristics); FIG. 4*d* also illustrating the signal reflection characteristics of a series of four antenna cells of the type depicted in FIG. 2*d*, (hyperbolic antenna cell variation); and FIG. 4*e* also illustrating the signal reflection characteristics of a series of four antenna cells of the type depicted in FIG. 2*e*, (gaussian variation). To provide a basis of comparison, the reflection characteristics depicted in FIGS. 4*a* through 4*e* are based on a series of four prior art antenna cells (antenna cells of the type illustrated in FIG. 2*f*), and a series of four antenna cells constructed in accordance with the invention, (antenna cells of the type illustrated in FIGS. 2*a* through 2*e*), wherein the reflection coefficients of the successive antenna cells are identical with respect to each reflection characteristic that is depicted in FIGS. 4*a* through 4*e*. Specifically, the reflection characteristics depicted in FIG. 4 are based on a series of four prior art antenna cells that respectively exhibit reflection coefficients of 0.5474, 0.5000, 0.4567 and 0.4171 and each series of four antenna cells that is constructed in accordance with the invention is structured so that the four consecutive cells exhibit reflection coefficients identical to the corresponding cells in the series of four prior art antenna cells. As will be understood upon considering FIGS. 4*a*–4*e*, a series of four antenna cells configured in accordance with the invention provides signal reflection comparable to that obtained by a series of four prior art antenna cells.

Referring now to FIG. 4*a*, reflection coefficient characteristic 82 is a staircase-like curve wherein the magnitude of the total reflected signal (i.e., the overall reflection characteristic) abruptly increases at positions that correspond to the abrupt impedance transitions (width modulations) of the prior art antenna cells. More specifically, in FIG. 4*a*, wherein the distance coordinates are expressed in terms of position along the four cells, it can be seen that a series of four prior art antenna cells of the type depicted in FIG. 2*f* exhibits an abrupt increase in reflection coefficient at points that correspond to the midpoint and terminus of each cell (i.e., at points corresponding to the two transitions between the narrow conductor region 46 and the wide conductor region 44 of cell 42 in FIG. 2*f*). As can further be seen in FIG. 4*a*, although the major contribution to signal reflection is attributable to the initial cell (approximately 62% for the four prior art cells under consideration), the remaining three cells provide additional signal reflection, so that the four cells collectively reflect substantially 100% of the signal.

Referring still to FIG. 4*a*, the signal reflection attributable to a series of four cells of the type shown in FIG. 2*a* is illustrated by curves 84 and 86, with curve 84 depicting the reflection characteristic of a realization, wherein the tapered regions (22 and 24 in FIG. 2*a*) of each cell are configured to exhibit linear variation in impedance, and curve 86 depicting the reflection characteristic of a realization of four linearly tapered cells, wherein the oppositely disposed edges of the tapered regions 22 and 24 are defined by linearly increasing and decreasing functions of distance along the antenna cell. As is shown in FIG. 4*a*, signal reflection characteristics 84 and 86 smoothly increase over the distance defined by the four antenna cells, reaching a value that is only slightly less than the value attained by four prior art antenna cells. In this regard, the inflection points or small regions of relatively constant signal reflection in reflection characteristics 84 and 86 correspond to the constant width regions of the antenna cells (i.e., regions 25 and 26 in FIG. 2*a*) and, thus occur at the approximate midpoint and terminus of each of the four antenna cells.

FIGS. 4*b* through 4*e* demonstrate that a series of four antenna cells of the types illustrated in FIGS. 2*b* through 2*e* also provide signal reflection comparable to the signal reflection obtained by a series of prior art antenna cells of the type depicted in FIG. 2*f*. For example, signal reflection curves 88 and 90 of FIG. 4*b* respectively illustrate the signal reflection typically obtained by realizations of antenna cells 30 (FIG. 2*b*), wherein the impedance of each antenna cell varies sinusoidally as a function of distance, and, wherein the oppositely disposed edges of the antenna cells are defined by sinusoidal functions of distance. As can be seen in FIG. 4*b*, there is no substantial difference between signal reflection characteristics 88 and 90. This is also true with respect to the previously discussed realizations of antenna cell 32 of FIG. 2*c*. In particular, and with reference to FIG. 4*c*, the signal reflection characteristic for a series of four antenna cells wherein the width of the antenna cell varies exponentially as a function of distance (reflection characteristic 92) is substantially the same as the reflection characteristic for a series of four antenna cells, wherein the impedance is an exponential function of distance, (reflection characteristic 94), and is substantially the same as the reflection characteristic for a series of four antenna cells wherein the oppositely disposed edges of the antenna cell are defined by exponential functions of distance (reflection characteristic 96).

As is shown in FIG. 4*d*, a series of four antenna cells each including regions wherein the antenna cell modulation ratio is a hyperbolic function of distance, the impedance is a hyperbolic function of distance, and the oppositely disposed edges of the antenna cells are defined by hyperbolic functions of distance, provide signal reflection characteristics 98, 100 and 102, respectively, that are comparable to the reflection characteristic of a series of the prior art antenna cells. As can be seen in FIG. 4*d*, hyperbolically tapered antenna cells provide a somewhat closer approximation to signal reflection characteristic 82 of the prior art than is provided by the various other tapers that are used in the practice of the invention.

Figure 4E:
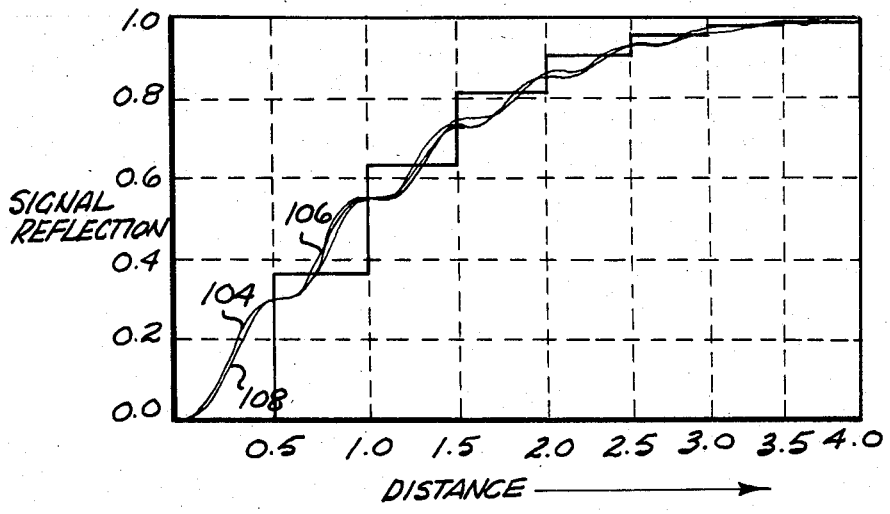

As is shown in FIG. 4*e*, realizations of the gaussian tapered antenna cells 40 of FIG. 2*e* also provide signal reflection comparable to that attained with the prior art structure of FIG. 2*f*. In FIG. 4*e*, the signal reflection obtained with a series of four antenna cells wherein each antenna cell includes regions in which the modulation ratio is a gaussian function of distance is represented by reflection characteristic 104, the signal reflection obtained by a realization wherein the impedance of each antenna cell is a gaussian function of distance is represented by reflection characteristic 106, and the signal reflection associated with a series of four cells wherein the oppositely disposed edges of each cell are defined by gaussian functions of distance is represented by reflection characteristic 108.

FIGS. 5*a*–5*e* depict the relationship between the signal reflection and electrical length for the tapered sections of the previously discussed antenna cell configurations of FIGS. 2*a*–2*e*. In each FIGS. 5*a*–5*e*, the coordinate values indicate electrical length of each tapered portion of the antenna cell, expressed in wavelengths. Thus, the zero coordinate value represents a taper length of "zero" wavelengths and corresponds to an abrupt impedance transition of the type associated with the prior art antenna cell depicted in FIG. 2*f*. The ordinate values in FIGS. 5*a*–5*e* are expressed in percent, relative to the signal reflection (i.e., the reflection coefficient of an abrupt impedance transition in the prior art antenna cell of FIG. 2*f*). That is, the ordinate values are normalized with respect to the reflection obtained with no taper and, hence, provide a comparison of signal reflection obtained in the practice of the invention and the magnitude of the reflection coefficient of an abrupt impedance transformation of the type utilized in the prior art antenna cell of FIG. 2*f*.

Since the coordinate values of FIGS. 5*a*–5*e* range between zero and four wavelengths, two important aspects of the invention are illustrated by these figures. Firstly, each FIGS. 5*a*–5*e* provides an estimate of the design frequency signal reflection for various realizations of the types of antenna cells depicted in FIGS. 2*a*–2*e*. Secondly, FIGS. 5*a*–5*e* provide an estimate of undesired signal reflection with respect to antenna current that passes beyond antenna cells that are configured for reflection of signals at that particular frequency. Both of these aspects of FIGS. 5*a*–5*e* can best be understood with more specific reference to the illustrated reflection characteristics.

Figure 5A:
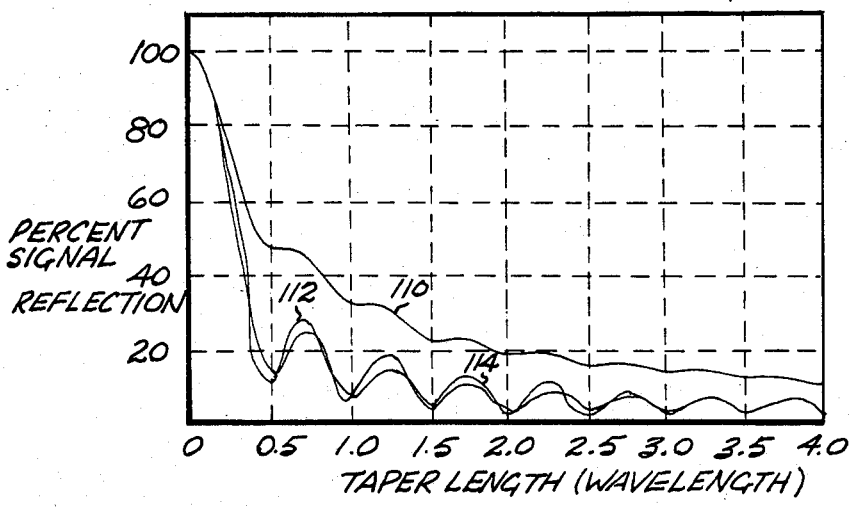
FIGS. 5*a*–5*e* illustrate the reflection coefficient-frequency characteristics of the antenna cells depicted in FIGS. 2*a*–2*e*.
Figure 5B:
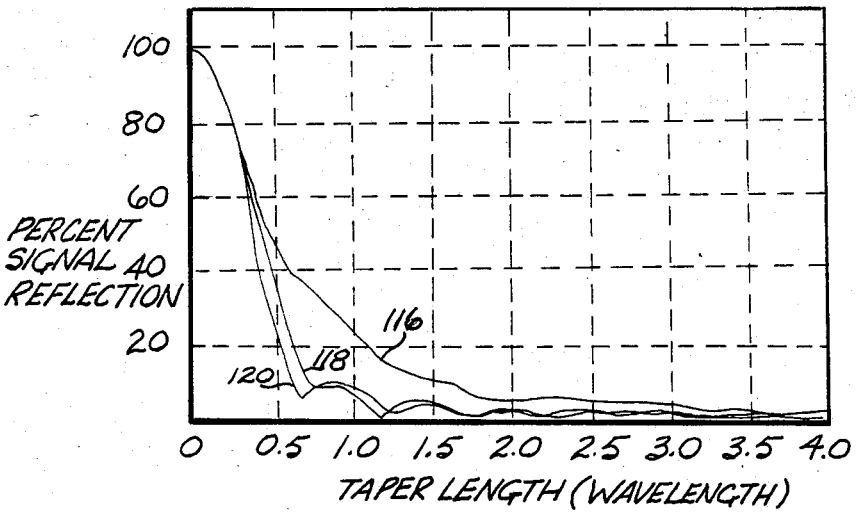
Figure 5C:
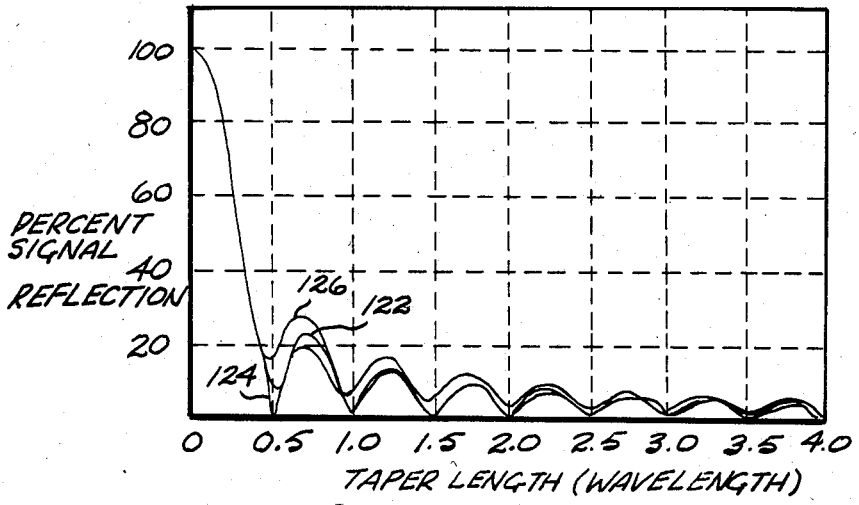
Figure 5D:
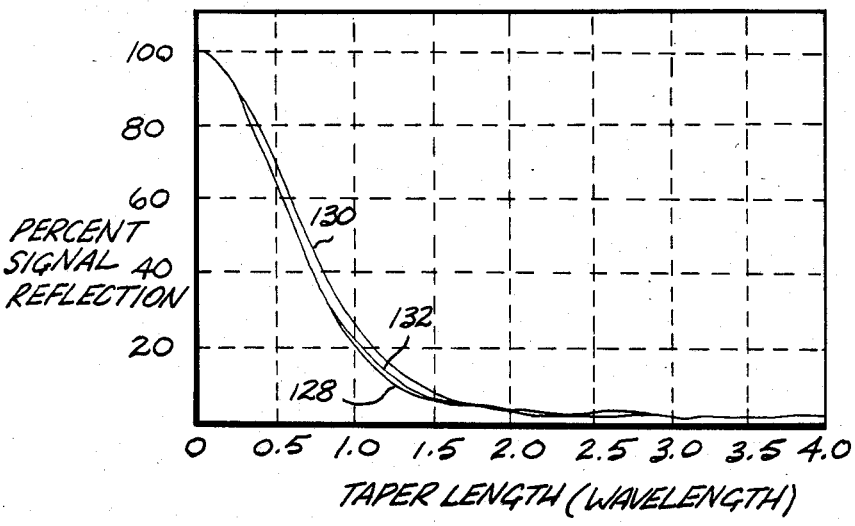
Figure 5E:
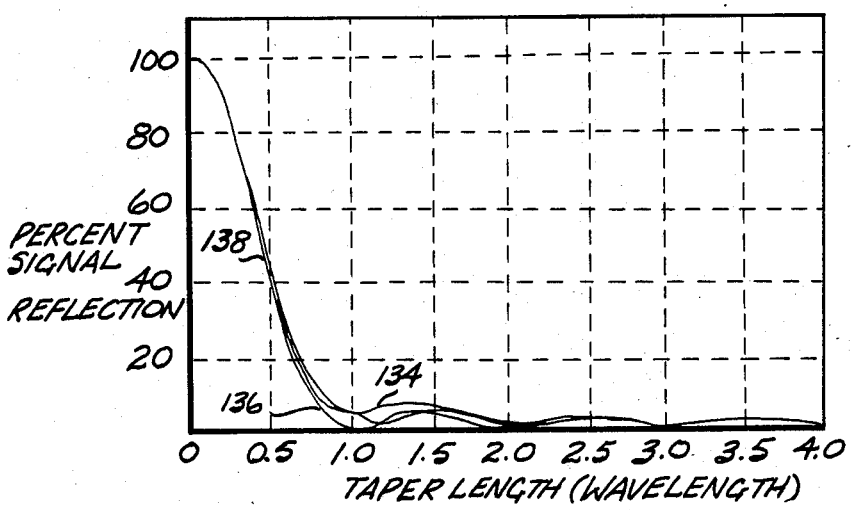

FIG. 5*a* illustrates the relationship between taper length and reflection for various realizations of the linearly tapered antenna cells of FIG. 2*a*, with curve 110 representing antenna cells wherein the modulation ratio of each tapered region varies as a linear function of distance along the antenna cell, curve 112 representing antenna cells wherein the impedance varies as a linear function of distance throughout each tapered portion of the antenna cell; and curve 114 representing linearly tapered antenna cells wherein the oppositely disposed edges of the tapered regions are linear functions of distance. As can be seen in FIG. 5*a*, the curves 110, 112 and 114 are substantially identical for tapered sections exhibiting a length within the range of zero to approximately 0.25 wavelengths. Since, as previously discussed, each antenna cell constructed in accordance with the invention is one-half wavelength long at the cell design frequency, the total length of each tapered section is necessarily no greater than 0.25 times the wavelength of the cell design frequency. Thus, as is demonstrated by FIG. 5*a*, the linearly varying modulation ratio tapered regions (curve 110), the linearly varying impedance tapered sections (curve 112), and the tapered sections having linearly varying edges (curve 114) provide comparable reflection coefficients for realizations of the antenna cells of FIG. 2*a* that have the same length tapered sections (regions 22 and 24 of antenna cell 20 in FIG. 2*a*). As is also illustrated by FIG. 5*a*, the magnitude of the reflection coefficient for these various realizations of antenna cell 20 decreases with increasing cell length, being approximately equal to 80% of the reflection coefficient of a prior art abrupt impedance transistion when each tapered cell is approximately one-quarter wavelength at the cell design frequency, (i.e., the antenna cell does not include constant width regions 25 and 26 in FIG. 2*a*).

For lengths greater than one-quarter wavelength, curves 110, 112 and 114 continue to decrease, reaching a minimum value at approximately 0.5 wavelengths and then periodically increase and decrease to form a curve similar to a damped sine wave having a period substantially equal to one-half the wavelength of the cell design frequency. In this regard, curve 110 exhibits substantially higher signal reflection than curves 112 and 114 throughout the region extending between 0.5 and 4.0 wavelengths and exhibits less oscillatory behavior than curves 112 and 114. The significance of this portion of FIG. 5*a* can be understood by recalling that neither the antenna cells of a prior art spiral antenna or cells constructed in accordance with the invention totally reflect antenna excitation current at the cell design frequency and, hence, some of the excitation current passes outwardly beyond the intended reflection points. In antenna configurations that are designed to operate over a relatively wide frequency range, the current that passes beyond the intended reflection point often will produce reflections at additional antenna cells within that particular antenna arm. As previously mentioned, excitation current reflected in this manner can cause undesired radiation that results in asymmetry of the antenna radiation pattern. Since the antenna cells located outwardly of the point of intended signal reflection are electrically longer than the cells intended to reflect the antenna current, the region of FIG. 5*a* that extends between 0.25 wavelengths and 4.0 wavelengths provides an estimate of the amount of undesired reflection that will take place in a particular embodiment of the invention that utilizes the linearly tapered antenna cells of FIG. 2*a*. For example, when excitation current that flows beyond the intended reflection region reaches cells having tapered regions that are twice the length of a cell dimensioned for maximum reflection of that signal, tapered cells of the type having linearly varying cell width (curve 110) exhibit a reflection coefficient that is less than 20% of the magnitude of the reflection coefficient exhibited by a prior art abrupt transition antenna cell of the type depicted in FIG. 2*f*, while the reflection coefficient of a tapered section wherein the impedance is a linear function of distance (curve 112) and the reflection coefficient of a tapered section wherein the oppositely disposed edges of the tapered region are linear functions of distance (curve 114) are less than 5% of the reflection coefficient exhibited by the prior art antenna cell. Thus, utilization of antenna cells constructed in accordance with the invention significantly reduce the amount of signal reflection that occurs relative to antenna signals that flow beyond the intended reflection points.

Moreover, when antenna cells constructed in accordance with the invention are utilized instead of prior art abrupt impedance transition antenna cells, the signal reflection that occurs at points beyond the desired reflection point (i.e., outside the desired electrical radius of the antenna) is more uniformly distributed over the outer, inactive region of the antenna. That is, the magnitude of the reflection coefficient of the prior art abrupt transition antenna cells of FIG. 2*f* is a periodic function that reaches a maximum value (100% in terms of the normalized ordinate values of FIGS. 5*a*–5*e*), each time the antenna cell is an integral multiple of one-half a wavelength. Thus, in a wide band spiral antenna configuration, the portion of high frequency signals that is not reflected within the active region of the antenna is likely to encounter several antenna cells that exhibit relatively high reflection coefficients. Since these antenna cells are spaced along the antenna arms, the resulting signal reflections cause complex standing patterns that result in nonuniform radiation. On the other hand, in the practice of this invention, tapered antenna cells of lengths greater than 0.5 wavelengths exhibit reflection coefficients falling within a much narrower range. Thus, the reflection that does occur in the outer inactive region of the antenna is more uniformly distributed. This means that the resulting radiation is more uniform and, thus, has less effect on the symmetry of the antenna.

FIGS. 5*b*–5*e* respectively depict the relationship between taper length and signal reflection for sinusoidally varying tapers, exponentially varying tapers, hyperbolic taper variation and gaussian taper variation. In these figures, curves 116, 122, 128 and 134 illustrate the reflection characteristic for tapers wherein the modulation ratio is the indicated function of distance; curves 118, 124, 130 and 136 illustrate signal reflection characteristics wherein the impedance is controlled in the indicated manner; and, curves 120, 126, 132 and 138 illustrate the reflection characteristics for embodiments wherein the oppositely disposed edges of the taper are the controlled cell characteristic. In viewing FIGS. 5*b*–5*e*, it can be noted that each taper configuration discussed relative to FIGS. 2*b*–2*e* results in reflection coefficient-taper length characteristics that are similar to the characteristics exhibited by embodiments of the linearly tapered cells (FIG. 5*a*). Hence each of the antenna cells described relative to FIGS. 2*a*–2*e* result in improved spiral antennas that operate in accordance with the invention.

Those skilled in the art will recognize that the embodiments of the invention disclosed herein are exemplary in nature and that various changes and modifications can be made without departing from the scope and the spirit of the invention. For example, although the disclosed embodiments are planar antennas, the invention easily can be configured as a conical antenna. Further, although the antenna arms of the disclosed embodiments are planar conductors in which the desired impedance variations are attained by controlling conductor width, the invention can be practiced by comparable control of conductor thickness or conductor volume.

The embodiments of the invention in which an exclusive property or privilege is claimed are defined as follows:

1. A wide band multiarm spiral antenna for operation with both left-hand and right-hand circularly polarized radiation patterns, said spiral antenna comprising a plurality of conductive antenna arms that extend outwardly about an axis of rotation, each said antenna arm being formed by a series of cells that are configured and arranged to reflect current flowing outwardly in the antenna arm which includes those cells, the length of said cells increasing as a function of increasing distance from said axis of rotation, each said cell being configured and arranged to exhibit a monotonically decreasing electrical impedance over a first portion of the length of each said cell and a monotonically increasing electrical impedance over a second portion of said length of each said cell 2. The wide band multiarm spiral antenna of claim 1, wherein each said cell is configured and arranged to exhibit a linear decrease in said electrical impedance throughout said first portion of said length of each said cell and to exhibit a linear increase in said electrical impedance throughout said second portion of said length of each said cell.

3. The wide band multiarm spiral antenna of claim 1, wherein each said cell is configured and arranged to exhibit an exponentially decreasing impedance over said first portion of said length of each said cell, and to exhibit an exponentially increasing electrical impedance along said second portion of said length of each said cell.

4. The wide band multiarm spiral antenna of claim 1, wherein each said cell is configured and arranged to exhibit an electrical impedance that decreases as a hyperbolic function of distance throughout said first portion of said length of each said cell and to exhibit an electrical impedance that increases as a hyperbolic function of distance throughout said second portion of said length of each said cell.

5. The wide band multiarm spiral antenna of claim 1, wherein each said cell is configured and arranged to exhibit an electrical impedance that decreases as a gaussian function of distance throughout said first portion of said length of each said cell and to exhibit an electrical impedance that increases as a gaussian function of distance throughout said second portion of said length of each said cell.

6. The wide band multiarm spiral antenna of claim 1, wherein each said cell is configured and arranged to exhibit an electrical impedance that decreases as a sinusoidal function of distance throughout said first portion of said length of each said cell and to exhibit an electrical impedance that increases as a sinusoidal function of distance throughout said second portion of said length of each said cell.

7. The wide band multiarm spiral antenna of claim 1, wherein each said antenna arm is a substantially planar strip of conductive material and wherein the width dimension of each said cell uniformly increases throughout said first portion of said length of each said cell and said width dimension uniformly decreases throughout said second portion of said length of each said cell.

8. The wide band multiarm spiral antenna of claim 7, wherein said width of each said cell linearly increases throughout said first portion of said length of each said cell and linearly decreases throughout said second portion of said length of each said cell.

9. The wide band multiarm spiral antenna of claim 7, wherein said width dimension of each said cell exponentially increases throughout said first portion of said length of each cell and exponentially decreases throughout said second portion of said length of each said cell.

10. The wide band multiarm spiral antenna of claim 7, wherein the increase in width dimension over said first portion of said length of each said cell is a hyperbolic function of distance along said first portion of said length and the decrease in width dimension of each said cell is a hyperbolic function of distance along said second portion of said length.

11. The wide band multiarm spiral antenna of claim 7, wherein the increase in width dimension over said first portion of said length of each said cell is a sinusoidal function of distance along said first portion of said length and the decrease in width dimension of each said cell is a sinusoidal function of distance along said second portion of said length.

12. The wide band multiarm spiral antenna of claim 7, wherein the increase in width dimension over said first portion of said length of each said cell is a gaussian function of distance along said first portion of said length and the decrease in width dimension of each said cell is a gaussian function of distance along said second portion of said length.

13. The wide band multiarm spiral antenna of claim 1, wherein each antenna arm of said spiral antenna is a substantially planar strip of conductive material having oppositely disposed edges and wherein each of said oppositely disposed edges of each said cell is defined by a linearly increasing function relative to the distance from said axis of rotation throughout said first portion of said length of each said cell and each of said oppositely disposed edges is defined by a linearly decreasing function relative to the distance from said axis of rotation throughout said second portion of said length of each said cell.

14. The wide band multiarm spiral antenna of claim 1, wherein each antenna arm of said spiral antenna is a substantially planar strip of conductive material having oppositely disposed edges and wherein each of said oppositely disposed edges of each said cell are defined by an exponentially increasing function relative to the distance from said axis of rotation throughout said first portion of said length of each said cell and each of said oppositely disposed edges is defined by an exponentially decreasing function relative to the distance from said axis of rotation throughout said second portion of said length of each said cell.

15. The wide band multiarm spiral antenna of claim 1, wherein each antenna arm of said spiral antenna is a substantially planar strip of conductive material having oppositely disposed edges and wherein each of said oppositely disposed edges of each said cell are defined by a hyperbolic function of increasing value relative to the distance from said axis of rotation throughout said first portion of said length of each said cell and each of said oppositely disposed edges is defined by a hyperbolic decreasing function of decreasing value relative to the distance from said axis of rotation throughout said second portion of said length of each said cell.

16. The wide band multiarm spiral antenna of claim 1, wherein each antenna arm of said spiral antenna is a substantially planar strip of conductive material having oppositely disposed edges and wherein each of said oppositely disposed edges of each said cell is defined by a sinusoidal function relative to the distance from said axis of rotation throughout said first portion of said length of each said and each of said oppositely disposed edges is defined by a sinusoidal function relative to the distance from said axis of rotation throughout said second portion of said length of each said cell.

17. The wide band multiarm spiral antenna of claim 1, wherein each antenna arm of said spiral antenna is a substantially planar strip of conductive material having oppositely disposed edges and wherein each of said oppositely disposed edges of each said cell is defined by an increasing gaussian function relative to the distance from said axis of rotation throughout said first portion of said length of each said cell and each of said oppositely disposed edges is defined by decreasing gaussian function relative to the distance from said axis of rotation throughout said second portion of said length of each said cell.

* * * * *